United States Patent [19]

Boudreau

[11] 4,323,259

[45] Apr. 6, 1982

[54] TWO WHEEL ROLLER ICE SKATE

[76] Inventor: Robert J. Boudreau, 176 Linden Ave., Malden, Mass. 02148

[21] Appl. No.: 193,487

[22] Filed: Oct. 3, 1980

Related U.S. Application Data

[63] Continuation of Ser. No. 6,337, Jan. 25, 1979, abandoned.

[51] Int. Cl.[3] ..... A63C 17/06; A63C 17/18

[52] U.S. Cl. ..... 280/7.13; 280/11.23

[58] Field of Search ..... 280/11.22, 11.23, 11.25, 280/11.27, 7.13, 11.3, 11.19, 11.28

[56] References Cited

U.S. PATENT DOCUMENTS

| | | | |
|---|---|---|---|
| 226,835 | 4/1880 | Chesterman | 280/7.13 |
| 945,435 | 1/1910 | Anderson | 280/7.13 |
| 1,379,250 | 5/1921 | Clark | 280/11.25 |
| 2,212,589 | 8/1940 | Decker | 280/11.25 |
| 2,998,260 | 8/1961 | Meyer | 280/11.3 |
| 3,287,023 | 11/1966 | Ware | 280/11.22 |
| 3,355,184 | 11/1967 | Green | 280/11.19 |
| 3,885,804 | 5/1975 | Cudmore | 280/11.23 |

FOREIGN PATENT DOCUMENTS

| | | | |
|---|---|---|---|
| 215734 | 11/1909 | Fed. Rep. of Germany | 280/7.13 |
| 583010 | 12/1946 | United Kingdom | 280/11.28 |

*Primary Examiner*—David M. Mitchell

*Attorney, Agent, or Firm*—Pearson & Pearson

[57] ABSTRACT

A pair of identical brackets, each have a slot to receive the front, or rear, of the blade of an ice skate, each is detachably affixed thereon by set screws, and each has an upstanding arm which supports a downwardly inclined axle for a large diameter, rubber tired wheel. The front wheel is canted outwardly on the inward side of the shoe and the rear wheel is canted outwardly on the outward side of the shoe with the flattened ground engaging portions of the rubber treads overlapping about a quarter of an inch along the longitudinal center line of the shoe.

The brackets may be one piece and detachably affixed under the sole of a shoe.

2 Claims, 4 Drawing Figures

TWO WHEEL ROLLER ICE SKATE

RELATED APPLICATION

This is a continuation, of application Ser. No. 6,337, filed Jan. 25, 1979 now abandoned.

BACKGROUND OF THE INVENTION

It has heretofore been proposed to provide a plurality of large diameter wheels, aligned in a straight line under the sole of a shoe, to serve as a roller skate as in U.S. Pat. No. 1,497,224 to Ormiston of June 10, 1924 or small diameter wheels so aligned as in U.S. Pat. No. 3,339,936 to Hamlin of Sept. 5, 1967 and U.S. Pat. No. 3,387,852 to DeSarro of June 11, 1968.

It has also been proposed to provide a single large diameter wheel on one side of the centre of a shoe to form a single wheel roller skate as in U.S. Pat. No. 2,931,012 to Kosach of Mar. 29, 1960 and to provide two large diameter wheels on one side of the front and rear of a shoe as in U.S. Pat. No. 1,552,541 to Clark of Sept. 8, 1925 and U.S. Pat. No. 3,885,804 to Cudmore of May 27, 1975. In both patents the wheels are canted outwardly so that the ground engaging portions are under the axial centre line of the sole plate. This is also true of the two wheel roller skates disclosed in German Pat. No. 215,734 and Italian Pat. No. 425,889.

SUMMARY OF THE INVENTION

In this invention a pair of large diameter wheels are used, but the front wheel is on the inward side of the shoe, the rear wheel is on the outward side of the shoe and the wheels are oppositely canted so that the ground engaging portions overlap each other along the axial centre line of the shoe to define a straight path about one half inch in width.

Preferably the identical front and rear wheels are each rotatable on axles fixed to identical clamp brackets, the brackets each including an elongated slot for receiving the front or rear of the blade of an ice skate and set screws detachably affix them in place.

Thus an ice shoe skate can be used for roller skating by clamping one bracket on the front of the blade and clamping the other bracket reversely on the rear of the blade, so that the wheel treads overlap on the axial centre line and the front and rear of the treads serve as bumpers to protect the blade.

While it is preferred, for cost and manufacturing reasons, to have the front and rear units identical, in another embodiment the front and rear brackets may be one piece and have laterally extending flanges for detachable affixation on the sole of a bladeless shoe.

DESCRIPTION OF THE PREFERRED EMBODIMENTS

Figure 1:
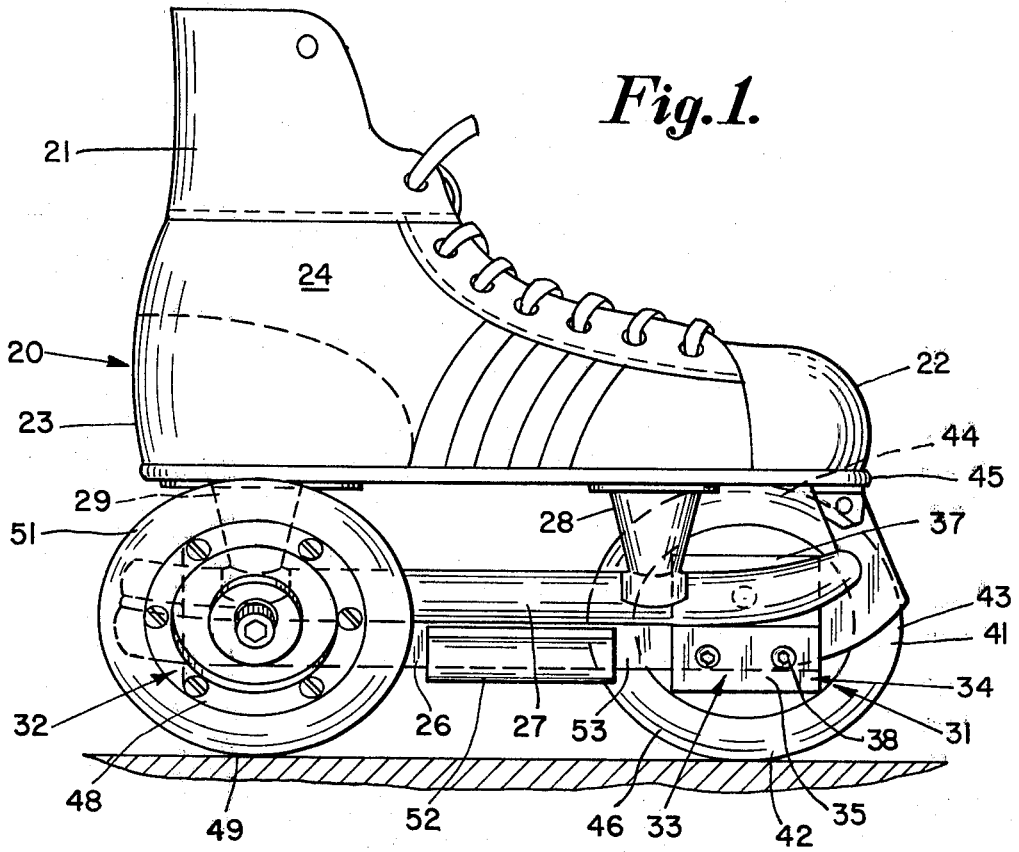
FIG. 1 is a side elevation of a typical ice shoe skate with the pair of identical wheel brackets clamped on the blade.
Figure 2:
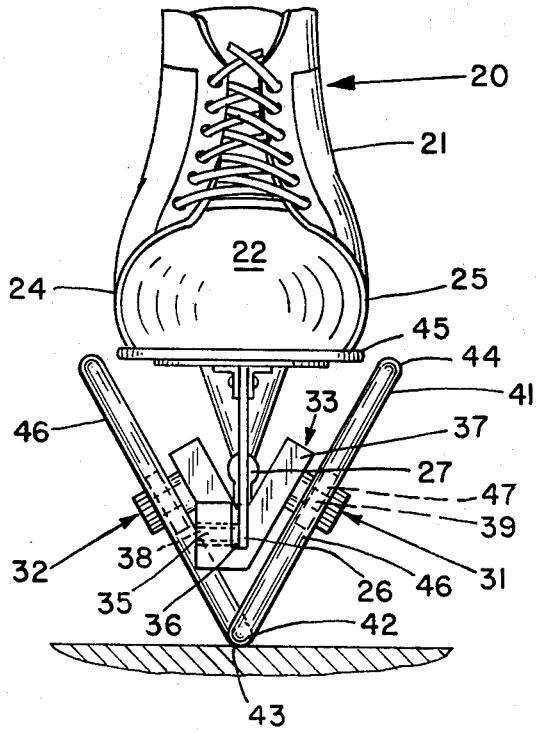
FIG. 2 is a front elevation of the two wheel roller ice skate shown in FIG. 1.

As shown in FIGS. 1 and 2, the preferred embodiment of the invention includes a typical ice skate 20, having a shoe 21, with a toe 22, heel 23, an outward side 24, an inward side 25, an ice skate blade 26, an elongated blade support 27, front post 28 and rear post 29. The ice skating blade 26 defines the longitudinal centre line of the ice skate 20. The ice skate 20, in this invention, is unaltered and of a commercially available type so that it may be used for its ice skating purpose whenever desired.

A pair of identical members 31 and 32 are provided for quickly and easily converting the ice skate 20 into a two wheel roller skate.

Members 31 and 32 may each serve as either the front member or the rear member, one being merely reversed relative to the other when clamped on the blade 26.

Member 31, shown at the front of blade 26, comprises front bracket means 33, mounted under the toe 22 of shoe 21 and formed of rigid material such as aluminum metal. Front bracket means 33 includes clamp means 34 for detachable affixation on the blade 26, there being an upstanding clamp arm 35 separated by an upward opening, elongated slot 36 from an upstanding axle support arm 37, the arm 37 being angularly disposed to the slot 36 and extending upwardly and outwardly therefrom.

The clamp arm 35 includes at least two set screws such as 38 threaded therein and operable across the slot 36 to firmly, but detachably clamp the front bracket means 33 on the toe portion of the blade. A front axle 39 is affixed to axle support arm 37 to extend downwardly at an angle thereto and a front, rubber tired wheel 41 of large diameter, such as four inches, is rotatable on the inclined axis of axle 39. The front wheel 41 is canted so that the ground engaging portion 42 of the tread 43 will define a longitudinal path directly under blade 26 and under slot 36, while the opposite upper portion 44 of the tread reaches up to about the level of and to one side of the level of the sole 45 of shoe 21.

The rubber tire 46 is preferably of solid rubber and about one quarter inch in cross sectional diameter and the wheel 41 is of light metal such as aluminum to reduce weight. Suitable side thrust bearings 47 are provided between wheel 41 and axle 39. The cant angle of the front wheel 41 is about 30° from the vertical and the slot 36 is of predetermined depth, such as about one half inch, as compared to the height of the portion of the blade exposed below its support 27 of about five eighths of an inch thereby enabling the ice skate blade to be repeatedly sharpened without losing the firm seat of the clamp.

Member 32, as stated above is identical with member 31, but is reversed when clamped on the rearward portion of blade 26, so that the front wheel 41 is on the inward side 25 of the shoe to better enable start up and turns and the rear wheel 48 is on the outward side 24 of the shoe to avoid contact of the wheels during skating.

The ground engaging portion 49 of the tire 51 of wheel 48 is directly under the blade 26 and slot 36 so that the ground engaging portions 42 and 49 are along the longitudinal centre line of the shoe. Depending on the weight of the skates, the rubber tires 46 and 51 of the wheels 41 and 48 will flatten accordingly in their ground engaging portions to mutually define a path about one quarter inch in width which gives the skater a broad base of support much as would occur with a wide ice skate blade.

As shown in FIG. 1, a blade guide 52 of U-shaped cross section is detachably spring clamped on the portion 53 of blade 26 between the front member 31 and the identical rear member 32 to prevent damage to the ice skate blade 26 during roller skating use.

Figure 3:
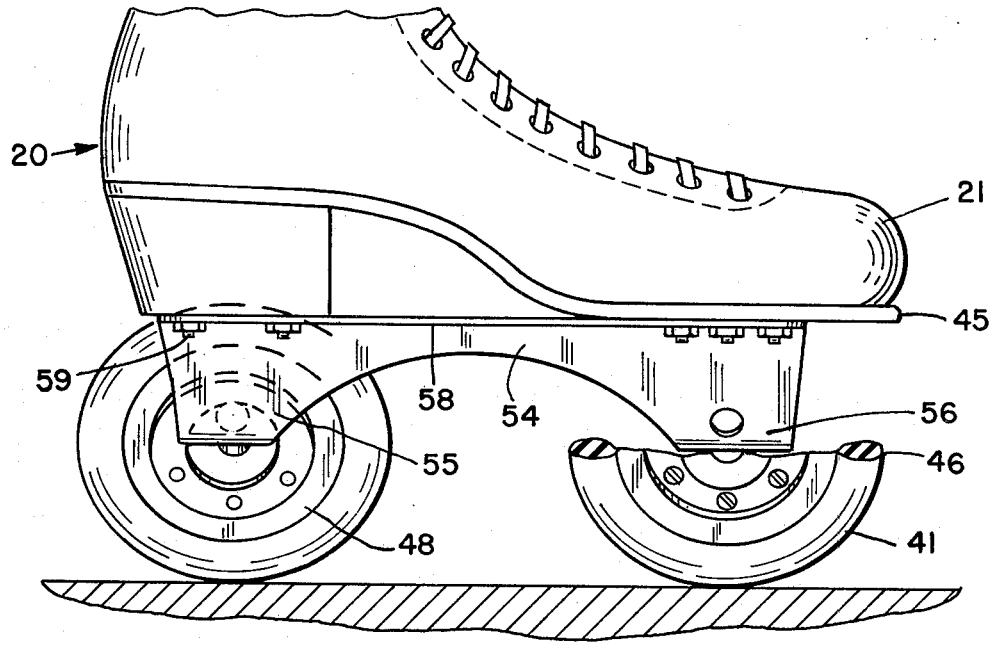
FIG. 3 is a fragmentary side elevational view showing a two wheel roller skate in which the two brackets are combined in one piece and attached directly to the sole of a shoe.
Figure 4:
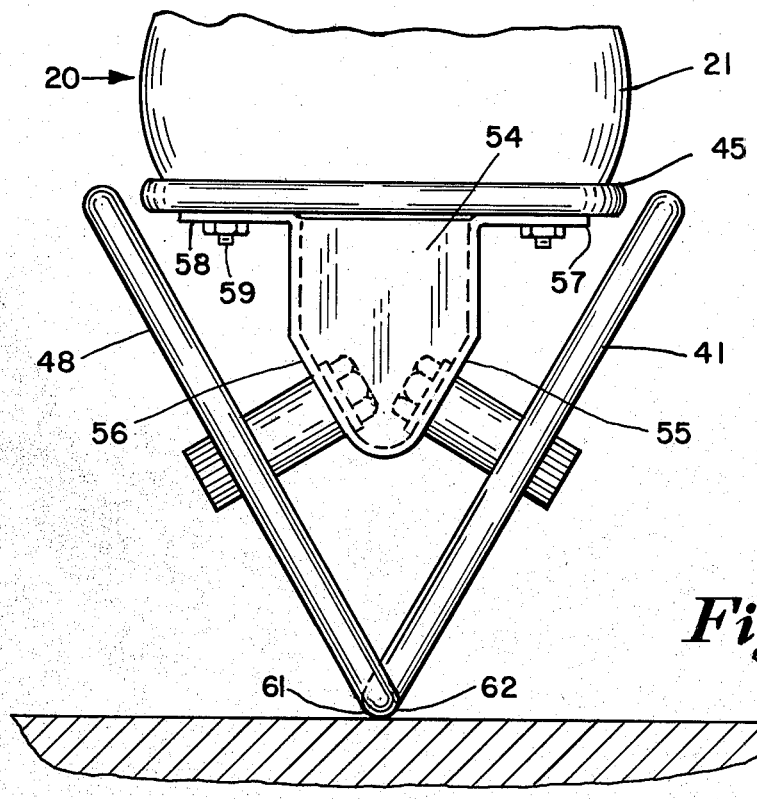
FIG. 4 is a front elevation, similar to FIG. 2, but on an enlarged scale showing the embodiment of FIG. 3.

In another embodiment of the invention shown in FIGS. 3 and 4 a shoe 21, having no ice skate blade, is provided with a one piece bracket means 54 of U-shaped cross section having an axle support wall 55, on one side, at an angle of about thirty degrees from the vertical and an axle support wall 56, on the other side, also at an angle of about thirty degrees from the vertical. Opposite integral horizontal flanges 57 and 58 enable the bracket means 54 to be detachably affixed by screws 59 to the bottom of the sole 45 of the shoe 20. The bracket means 54 thus constitutes an elongated sole attachment plate by which the two wheels 41 and 48 may convert the shoe into a two wheel roller skate with the front wheel canted outwardly on the inward side of the shoe and the rear wheel canted outwardly on the outside of the shoe so that their respective ground engaging portions 61 and 62 overlap to define a relatively wide path under the axial centre line of the shoe.

I claim:

1. In combination with an ice shoe skate having an ice blade a two wheel roller ice skate attachment for converting said shoe ice skate into a roller skate:

said attachment comprising a pair of identical bracket clamps each having an elongated slot for receiving a portion of the blade of said skate;

clamp means on each said bracket clamp for detachably affixing one said bracket proximate the toe of said blade and the other said bracket proximate the heel of said blade;

an integral axle support arm on each said bracket extending upwardly and away from the slot therein at a predetermined angle;

an axle extending away from each said arm and normal thereto;

and a pair of rubber tired wheels, each rotatable on one of said axles;

one said bracket clamp being affixed along the toe portion of an ice skate blade with the wheel thereof canted outwardly on the inward side of the shoe and the other said bracket being affixed reversely along the heel portion of said ice skate blade with the wheel thereof canted outwardly on the outward side of the shoe;

the treads of said wheels overlapping laterally and defining a ground engaging path directly beneath and parallel to the longitudinal centre line of said shoe.

2. As an article of manufacture:

a bracket clamp of rigid material for attachment on an ice skate blade said clamp having;

an upstanding set screw arm and an upstanding axle support arm, said arms jointly defining therebetween an elongated slot for receiving a portion of said ice skate blade;

set screws threaded in said set screw arm and operable in said slot for detachably affixing said blade in said slot;

said axle support arm being angularly disposed to said set screw arm and of substantially greater height than said set screw arm to extend outwardly and upwardly therefrom;

an axle affixed normal to said axle support arm proximate the upper end thereof and substantially above the level of said slot and set screw in said set screw arm;

and a wheel mounted to rotate on said axle at an angle to said slot and with the lower portion of the tread thereof located directly below said slot at a spaced distance therefrom.

* * * * *